US005173987A

United States Patent [19]

Buckingham

[11] Patent Number: 5,173,987

[45] Date of Patent: Dec. 29, 1992

[54] ROTARY AIR JET SCREEN CLEANING DEVICE

[75] Inventor: Paul J. Buckingham, Abington, Mass.

[73] Assignee: Abington, Inc., N. Abington, Mass.

[21] Appl. No.: 685,467

[22] Filed: Apr. 12, 1991

[51] Int. Cl.[5] ..... A47L 5/38

[52] U.S. Cl. ..... 15/301; 15/316.1; 15/319; 55/302

[58] Field of Search ..... 15/301, 316.1, 319, 15/345; 55/302

[56] References Cited

U.S. PATENT DOCUMENTS

| | | | |
|---|---|---|---|
| 3,471,890 | 10/1969 | Ramo | 15/301 |
| 3,486,309 | 12/1969 | Wild | 15/301 X |
| 3,628,213 | 12/1971 | Ramo | 15/301 X |
| 4,356,010 | 10/1982 | Meyer | 55/302 |
| 4,655,799 | 4/1987 | Bosworth et al. | 55/302 X |
| 4,854,951 | 8/1989 | Stephenson | 55/302 X |

*Primary Examiner*—Chris K. Moore
*Attorney, Agent, or Firm*—Cort Flint

[57] ABSTRACT

In a vacuum cleaning system in which the top dome and receiving shell are separated by a screen, a screen cleaning system comprising an air knife having a coanda profile rotatably arranged in the dome adjacent the screen. The vacuum cleaning system is selectively actuated in accordance with a timed program to clean lint and debris from the screen.

16 Claims, 2 Drawing Sheets

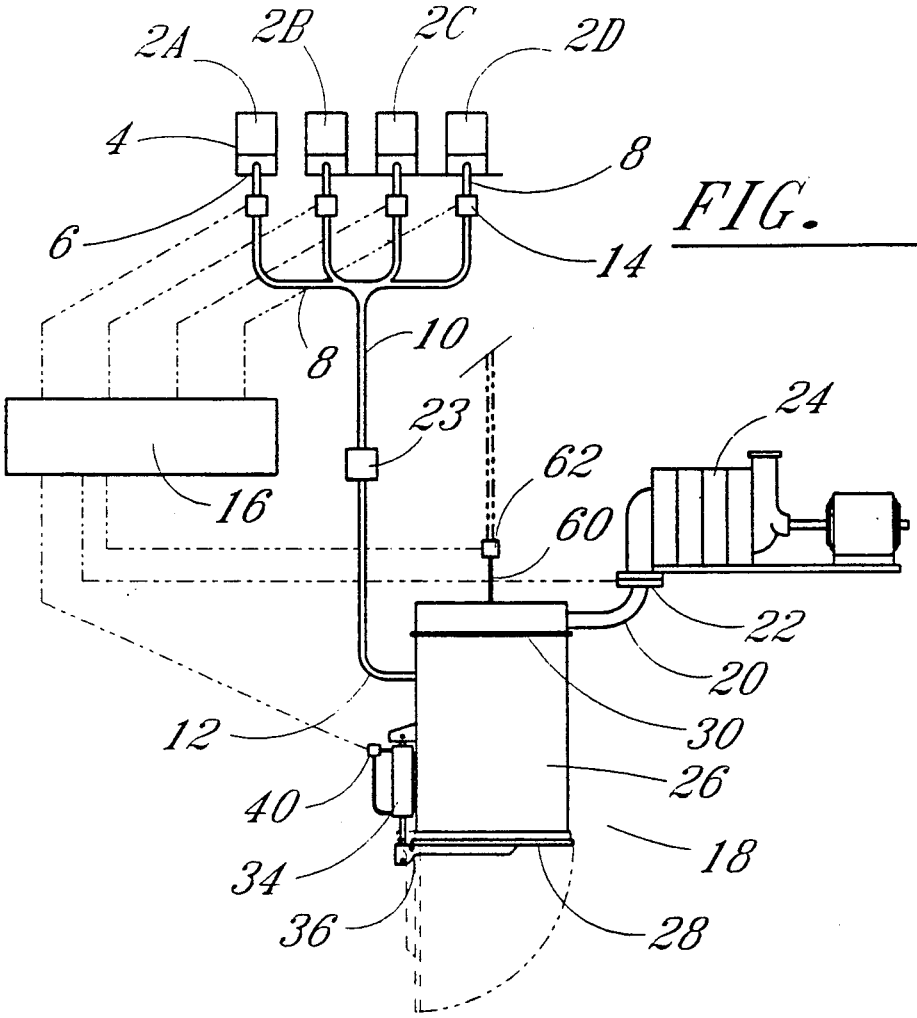
FIG. 1
FIG. 2
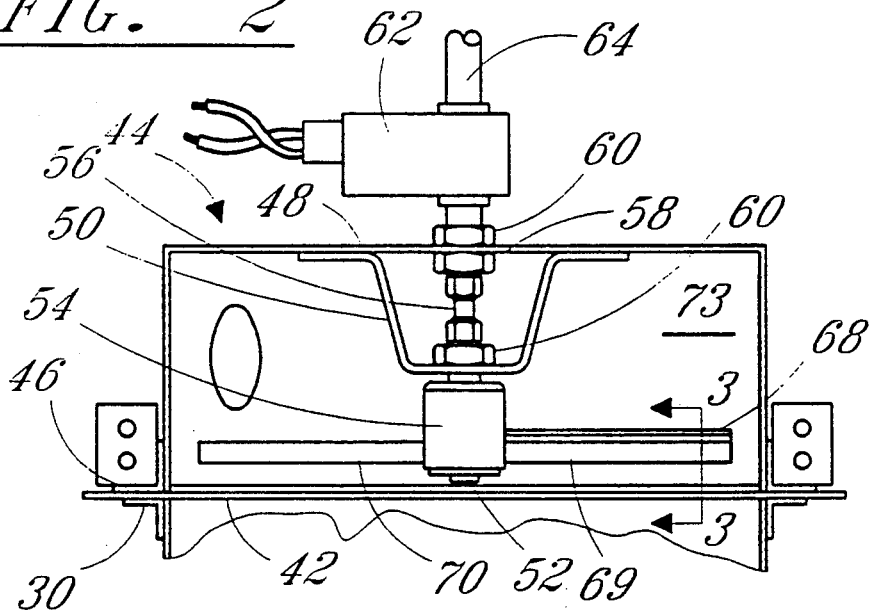

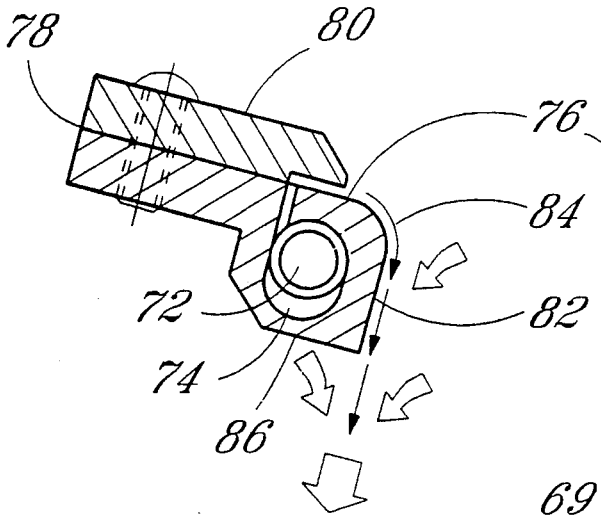
FIG. 3
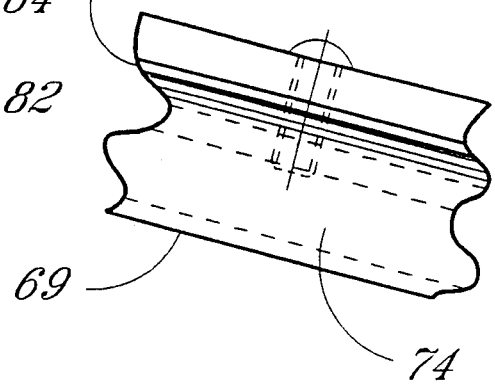
FIG. 4
FIG. 5
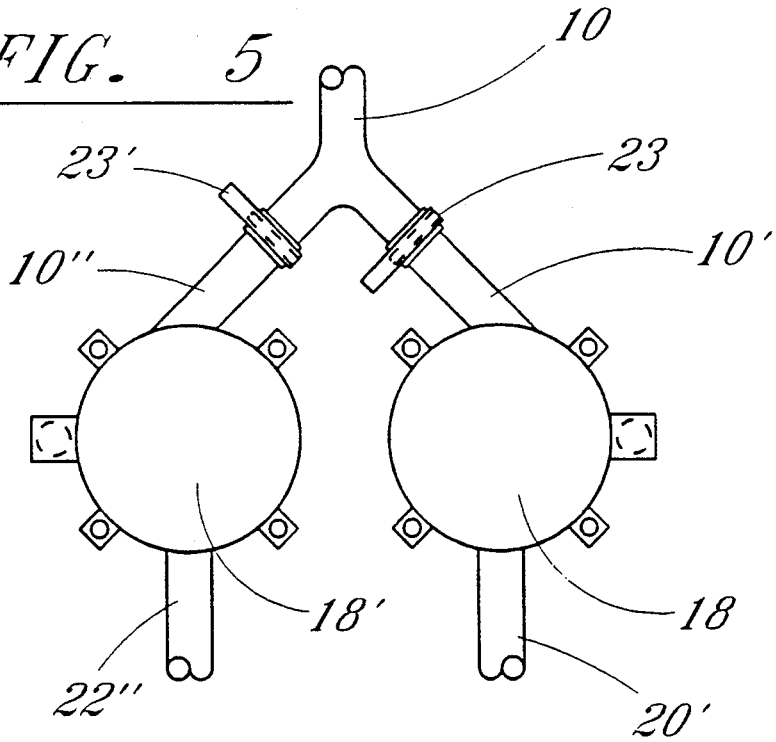

ROTARY AIR JET SCREEN CLEANING DEVICE

BACKGROUND OF THE INVENTION

As discussed in U.S. Pat. No. 3,628,213, which is also assigned to Abington Textile Machinery Works, it is desirable in vacuum cleaning devices to clear the tank after each collection of lint and debris has been delivered thereto. This clearing cycle can of course be altered to be after every two or three deliveries. Also, the arrangement may include a plurality of receiving tanks which may alternately receive the collected residue.

It has been found that the lint and other residue tend to collect on the screen which separates the dome and collection tank. Should the screen become clogged, it must be replaced. This requires down time and loss of production.

Attempts have been made to provide screen cleaning air knives. To date, these have not been entirely satisfactory due to the large volume of air required to remove the residue. Also, there have been problems with wind sheer and noise.

Prior U.S. Pat. Nos. 3,377,780, 4,036,613, and 4,810,270 illustrate various types of air knives used to clean screens in filter apparatus and fiber separating apparatus. These types of air knives have been found to be unsatisfactory for use with vacuum cleaning devices of the type disclosed.

It is an object of the present invention to overcome the disadvantages of the systems as above set forth.

It is another object of the invention to provide an air knife cleaning system which operates with a minimum of compressed air while at the same time producing a cleaning curtain of air of large volume.

It is another object of the invention to provide a screen cleaning apparatus capable of effecting cleaning cycles every five minutes.

It is another object of the invention to provide a screen cleaning system which will integrate into the cyclic operation of the vacuum cleaning system.

It is another object of the invention to provide a screen cleaning system which will also assist in the removal of residue from the receiving tank.

SUMMARY OF THE INVENTION

A vacuum cleaning apparatus which applies a vacuum by a vacuum pump to an accumulation of waste to suck same into an inlet of a piping system having therein waste receiving means for collecting the waste. A first piping section providing communication between the inlet and the waste receiving means and a second piping section providing communication between the waste receiving means and the pump. The waste receiving means includes a receiver shell to which the first piping section is connected and a top dome to which the second piping section is connected. A screen is arranged to separate the top dome and the receiver shell. A screen cleaning assembly is arranged above the screen. The assembly includes a hollow spindle arranged centrally of the dome which extends toward the screen so that a first end thereof is located adjacent to the screen. An air knife which has a coanda profile is rotatably attached to the first end of the spindle. The knife is in communication with the hollow interior of the spindle. The knife is arranged to extend substantially perpendicularly the spindle. A balance means is attached to the spindle also at the first end. The balance means extends co-extensive with, but opposite to the knife.

The knife includes an inlet, a plenum chamber, a throttled nozzle and a coanda profile. Compressed air is supplied through the hollow spindle and the inlet to the plenum. The plenum supplies the air to the nozzle. The result is that the air ejected through the nozzle adheres to the coanda profile while at the same time entraining surrounding air. This results in a high velocity, high volume sheet of air being directed against the screen to remove any lint and other residue which may have accumulated thereon.

Apparatus for removing and conveying industrial wastes from a plurality of stations. Each station comprises at least one waste inlet at which wastes accumulate, vacuum pump means, waste receiving and collecting means, first conduit means for providing communication from each station to the waste receiving and collecting means, and second conduit means providing communication from the last-mentioned means to the pump means. An inlet valve for each of the stations and control means for automatically opening and closing the valves successively and repetitively in accordance with a predetermined time program. Finally, means for intermittently unloading the waste which collects in the waste collecting means without interrupting the repetitive program. The unloading means includes a valve which prevents flow of air from the waste receiving means to a substantial volume of the conduit. The unloading means also comprises a waste removal door associated with the waste receiving means and means for releasing the vacuum in the waste receiving means and opening the door when an inlet valve is closed and for deactuating the vacuum release means and closing the door when the inlet valve is opened. The screen is located between the first and second conduit means and screen cleaning means are arranged above the screen. The screen cleaning means comprises a source of compressed air, a rotatably mounted air knife having a coanda effecting surface connected with the source of compressed air and control means arranged to activate and deactivate the flow of compressed air from the source to the knife. The control means is controlled to activate the flow of compressed air to the knife when the door is open and to deactivate the flow of compressed air when the door is closed.

The waste receiving and collecting means comprises a cylindrically shaped dome assembly and receiver shell. The screen is mounted between adjacent ends of the dome and the shell and a rotatably mounted spindle which is co-extensive of the axis of the waste receiving and collecting means extends from a second end of the dome to a point adjacent the screen. The knife connected to the spindle is caused to rotate upon activation of the flow of compressed air through the jet. The knife extends from the spindle at a slight angle to the plane of the screen, appropriately at an angle of 15°. The knife extends along substantially the entire radius of the dome.

A balance arm is mounted to the spindle to extend oppositely of the knife. Vacuum cleaning apparatus having a circular receiver shell mounting at one end a circular screen and a circular top dome, a rotary air jet cleaning system depending from an opposite end of the dome to locate an air knife adjacent to the screen. The knife is arranged to extend at a slight angle along substantially the entire radius of the dome. The knife includes an outlet nozzle which extends along substantially its entire length, the nozzle is arranged adjacent a coanda profile which comprises a first surface which is parallel the nozzle and a second surface which is 90° of the first surface. The coanda profile is arranged at a slight angle to the horizontal plane of the screen so that a jet of compressed air delivered by the nozzle along the coanda profile adheres to the profile through 90° to be directed as a stream of air onto the screen. This action propels the knife through its rotary motion about the screen. The knife includes an inlet which is connected with a plenum chamber. The plenum chamber extends substantially along the entire length of the knife. The outlet nozzle is in communication with the plenum along its entire length. Air supply means are arranged to deliver compressed air to the inlet at between 90 and 100 psi.

Control means are provided to interrupt the supply of air from the supply means. The control means are controlled to be activated in synchronization with certain operating cycles of the vacuum cleaning device.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 1 is a diagrammatic view of a vacuum waste removing system with which the air cleaning system of the invention may be adapted;

FIG. 2 is a side view, cut away, showing the air knife arrangement associated with a dome assembly;

FIG. 3 is an end view of the air knife showing the coanda profile;

FIG. 4 is a sectional side view of the air knife showing the air nozzle; and

FIG. 5 is a top view of an alternate arrangement in which two vacuum tanks are incorporated in the system.

DESCRIPTION OF A PREFERRED EMBODIMENT

FIG. 1 represents a vacuum system according to the invention as applied to a plurality of carding machines 2A, 2B, 2C, and 2D. Accumulations of lint and other residue are indicated at 4 with inlet openings 6 arranged adjacent thereto. Each inlet 6 is connected to a conduit 8 of the intake system. Conduits 8 are each connected to a main intake conduit 10 which connects with inlet opening 12 of the collection tank 18.

As set forth in our earlier U.S. Pat. No. 3,628,213, control valves 14 are associated with each conduit 8 adjacent to opening 6 and are controlled by timer 16. Timer 16 acts on valves 14 sequentially to connect the conduits 8 with intake or main conduit 10 so that the lint and residue 4 from each station is sequentially entrained in a vacuum created in the return system and is delivered to collection tank 18. Collection tank 18 is connected through outlet conduit 20 to a vacuum creating pump 24. A valve 22 is arranged in conduit 20 adjacent to tank 18 and is controlled by timer 16 to connect and disconnect the vacuum created by pump 24 with tank 18.

It is desirable to remove the lint and residue from tank 18 immediately after its delivery from a collection point. This is accomplished by means of a swing door 28 arranged as the lower or floor surface of cylindrical shell 26 of the waste receiver tank.

Door 28 is controlled through an open and closed position by pneumatic piston member 34. Piston 34 causes door 28 to pivot about point 36 between an open and a closed position. Piston 34 is connected through valve means 40 to timer 16 which actuates the piston in sequence with the operation of the accumulating device.

Receiver tank 18 consists of cylindrical shell 26 to which main intake conduit 12 is connected. The upper edge of shell 26 includes a receiving surface 30 on which is arranged screen 42. Cylindrical dome 44, which has a receiving lower surface 46, is secured to upper surface 30 to position screen 42 between shell 26 and dome 44 of tank 18.

Referring now to FIG. 2, it can be seen that frame 50 is secured to the inner side of top 48 of dome 44. Frame 50, to which is attached a hollow spindle 56, is located to be coincident with the axis of dome 44. An upper end of spindle 56 is connected at 58 to tube 64 which passes through top 48 of dome 44 at 60. Appropriate means such as bolts 60 secure spindle 56 to frame 50 and to top 48. A two-way solenoid valve 62 is arranged to connect and disconnect tube 64 with a source of compressed air. Solenoid valve 62 is connected to timer 16 to also be sequentially controlled thereby.

It is noted that the particular attachment arrangement for attaching spindle 56 with top 48 of dome 44 is only one of several alternative arrangements. For example, spindle 56 could be simply welded to top 48 with the dome. Tube 64 could then be connected somewhere along the length of spindle 56 and passed through side wall 73 of the dome.

Bearing 54, which contains a hollow passageway connected to the hollow interior of spindle 56, is rotatably mounted to the end of the spindle in any suitable manner. The spindle extends from top 48 to a position so that its opposite end 52 is adjacent screen 42. Connected to bearing 54 is an air knife 68. Also connected to bearing 54 is balance arm 70. Knife 68 extends radially from bearing 54 to a point substantially adjacent inner wall 72 of dome 44. Knife 68 may extend perpendicularly of the axis of spindle 56 or at a slight angle thereto; approximately 15°. The clearance between the end of the air knife and wall 73 is between 0.38" and 1.0".

Balance arm 70 extends from bearing 54 co-extensive with knife 68 but oppositely therefrom. Arm 70 and knife 68 are of approximate equal weight. Knife 68, which includes elongate portion 69, is connected to the hollow passageway of bearing 54 by means an inlet 72 (see FIGS. 3 and 4). Inlet 72 opens into a plenum chamber 74 formed in elongate portion 69 to extend the entire length thereof. Formed along top edge 78 by member 80 is an elongate thin nozzle 76. Nozzle 76 is co-extensive of chamber 74 so as to extend substantially the entire length of the knife. Upper planar surface 78 terminates with a rounded forward edge 84 from which extends a planar forward surface 82. Lower surface 86 merges with forward surface 82 to form a right angle.

When air knife 68 is operative, a jetted curtain of primary air emerges from nozzle 76. This primary air adheres to surface 78, moves about curved area 84, and down forward surface 82 due to the coanda profile. As the primary air curtain moves down forward surface 82, it begins to entrain surrounding air thus increasing the volume of air directed toward and onto the screen. This entraining action occurs with only a minimal of velocity loss due to the wall attachment effect. The interaction of the jetted air and entrained air acts to dampen air sheer and reduces noise levels dramatically. The action also reduces the volume at which the compressed air must be supplied. A minimum of 90 psi is required to be delivered to the knife although air up to 110 psi is acceptable.

Knife 68 is mounted to bearing 54 so that upper surface 78 is arranged to be a t a minimum of 15° to the surface of the screen and surface 82 at 75° to the surface of the screen. This creates a downward motion of the air curtain which is at a sufficient angle to rotate the knife about screen 42 while at the same time providing sufficient downward thrust to clean the entire screen. Here again, the knife is not limited to a 15° setting and may be set at other angles to screen surface.

The cleaning arrangement above described is operable with a variety of receiver sizes to include those having a 24" diameter, a 30" diameter and a 48" diameter.

In operation, the arrangement operates as follows. Timing device 16 connects a single conduit 8 with main intake conduit 10. The lint and residue 4 is drawn through inlet 6 and delivered to tank 18. During this time, pump 24 is active and connected to tank 18 through an open valve 22 so as to create the suction force which draws and delivers lint and residue 4 into tank 18. Upon delivery of the lint and residue, valves 22 and 23 are closed by timer 16 and valve 40 is opened to actuate cylinder 34. This action swings door 28 away from the lower end of shell 26 allowing the collected lint and residue to fall from tank 18. At the same time, solenoid valve 62 is opened to allow compressed air to flow to and through blade 68. The sheet of compressed air passing through nozzle 76 acts to put blade 68 in motion and to deliver a downwardly directed air curtain against screen 42 which removes, toward open door 28, the residue collected thereon. At the completion of this operative cycle, door 28 is closed by cylinder 34, via valve 40 and knife 68 is deactivated by valve 62 interrupting the air supply through spindle 56. Valves 40 and 62 are controlled by timer 16. Timer 16 now selects another conduit 8 to connect to main intake conduit 10 and tank 18 and the process is repeated. This sequential selection occurs through all cleaning stations whereupon it is repeated throughout the work period of the carding machines.

The knife is activated to clean the screen approximately every five minutes. It is noted that the curtain of jetted air from knife 68 also act to assist in removing the lint and residue from tank 18.

Referring now to FIG. 5, there is shown an alternate arrangement in which a pair of tanks 18, 18' are connected to main intake conduit 10 through auxiliary conduits 10', 10''. Valves 23, 23' are arranged in auxiliary conduits 10', 10'' to connect and disconnect tanks 18, 18' with main conduit 10. Valves 23, 23' are controlled via timer 16 to alternately receive lint and residue 4 from one of the inlets 6 in accordance with the sequence previously set forth.

Likewise, auxiliary outlet conduits 20', 20'' are connected to a main outlet conduit and selectively placed on line through valve means in a manner similar to that described above.

Each tank 18, 18' will have an air knife cleaning arrangement as described above associated therewith. The air knife will also be controlled by timer 16 to operate in sequence with the tanks 18, 18'.

This arrangement allows for the unloading and cleaning of tank 18 to be taking place while tank 18' is on line collecting dust, lint, and other debris. The cycle is reversed when tank 18' is cleaned. In this manner, a constant suction is provided between main intake conduit 10 and openings 6.

While a preferred embodiment of the invention has been described using specific terms, such description is for illustrative purposes only, and it is to be understood that changes and variations may be made without departing from the spirit or scope of the following claims.

What is claimed is:

1. In a vacuum cleaning apparatus for applying a vacuum by a vacuum pump to an accumulation of waste to such said waste into an inlet of a piping system having therein waste receiving means for collecting said waste and having a first piping section providing communication between said inlet and said waste receiving means and a second piping section providing communication between said waste receiving means and said pump, said waste receiving means including a receiver shell to which said first piping section is connected and a top dome to which said second piping section is connected, and a screen separating said top dome and said receiver shell, the improvement comprising:

a screen cleaning assembly arranged above said screen;

said assembly including a hollow spindle arranged centrally of said dome and extending toward said screen so that a first end thereof is located adjacent said screen;

an air knife rotatably attached to said spindle at said first end and in communication with said hollow interior, said knife being arranged to extend substantially perpendicularly to said spindle;

balance means operative to counter the weight of said knife are attached to said spindle at said first end to extend co-extensive with, but opposite said knife;

said knife including an inlet, a plenum chamber, a throttled nozzle and an outer surface configured as a coanda profile to which an air stream will adhere; and means supplying compressed air through said hollow spindle and said inlet into said plenum which supplies said air to said nozzle; whereby, said air ejected through said nozzle adheres to said coanda profile of said outer surface and also acts to entrain surrounding air so that a high velocity, high volume sheet of air is directed against said screen to remove any lint and other residue which may have accumulated thereon.

2. Apparatus for removing and conveying industrial wastes from a plurality of stations, each station comprising at least one waste inlet at which wastes accumulate, vacuum pump means, a waste receiving and collecting container, first conduit means for providing communication from each said station to said waste receiving and collecting container and second conduit means providing communication from said container to said pump means, an inlet valve for each of said stations and control means for automatically opening and closing said valves successively and repetitively in accordance with a predetermined time program, and means for intermittently unloading the waste which collects in said waste collecting container without interrupting the repetitive program, said unloading means including a valve preventing flow of air from said waste receiving and collecting container to a substantial volume of said conduit means adjacent said inlet valves, said unloading means also comprising a waste removal door associated with said waste receiving and collecting container and means for releasing the vacuum in said waste receiving and collecting container and opening said door when an inlet valve is closed and for deactuating said vacuum release means and closing said door when said inlet valve is open;

a screen located between said first and second conduit means, and screen cleaning means arranged above said screen;

said screen cleaning means comprising a source of compressed air, a rotatably mounted air knife having a surface which has a coanda effecting profile to which a compressed stream of air will adhere, means connecting said air knife with said source of compressed air and control means arranged to activate and deactivate the flow of compressed air from said source to said knife; whereby said control means is controlled to activate the flow of compressed air to said knife when said door is open and to deactivate the flow of compressed air when said door is closed.

3. Apparatus of claim 2 wherein said waste receiving and collecting container comprises a cylindrically shaped dome assembly and receiver shell;

means mounting said screen between adjacent ends of said dome and said shell;

a spindle mounted co-extensive with the central axis of said waste receiving and collecting container from a second end of said dome to a point adjacent said screen;

a rotatable bearing connected to said spindle;

said knife being connected to said bearing; whereby activation of said flow of compressed air through said jet causes said air knife to rotate.

4. Apparatus of claim 3 wherein said knife includes an upper portion of said coanda surface which extends from said bearing at a slight angle to the plane of said screen.

5. Apparatus of claim 4 wherein said angle is 15°.

6. Apparatus of claim 4 wherein a balance arm is mounted to said bearing to extend oppositely of said knife.

7. Apparatus of claim 3 wherein said knife extends to a point substantially adjacent the inner periphery of said dome.

8. Apparatus of claim 2 wherein there are a plurality of waste receiving and collecting containers each connected to a corresponding station and said control means, said control means controlling said receiving and collecting means alternately through said predetermined time program.

9. Vacuum cleaning apparatus having a circular receiver shell and a circular top dome mounted between one end of said receiver shell and a first end of said top dome, a circular screen, an air jet cleaning system including a rotary air knife depending from a second end of said dome to be located adjacent to said screen, said knife being arranged to extend from said axis of rotation to a point substantially adjacent the inner periphery of said dome;

said knife includes an outlet nozzle which extends along substantially its entire length, said nozzle is arranged adjacent a first surface which is parallel to said nozzle and merges with a second surface which is 90° to said first surface to form a coanda profile to which air under pressure adheres; and the plane of of said first surface is arranged at a slight angle to the horizontal plane of said screen; whereby a jet of compressed air delivered by said nozzle adjacent said first surface of said coanda profile adheres to said profile through 90° and over said second surface to be directed as a jet stream of air onto said screen, said jet stream acts to clean said screen of debris and to propel said knife through rotary motion about said screen.

10. Apparatus of claim 9 wherein said knife includes an inlet which is connected with a plenum chamber which extends substantially along the entire length of said knife, and said outlet nozzle is in communication with said plenum along its entire length.

11. Apparatus of claim 9 wherein air supply means are arranged to deliver compressed air to said inlet.

12. Apparatus of claim 11 wherein control means are provided to interrupt the supply of air from said supply means.

13. Apparatus of claim 12 wherein said control means are controlled to be activated in synchronization with certain operating cycles of said vacuum cleaning device.

14. Apparatus of claim 11 wherein said air supply means supplies air at between 90 and 100 psi.

15. Apparatus of claim 9 wherein said first surface is arranged at 15° to the horizontal surface of said screen.

16. Apparatus of claim 9 wherein said jet of air traveling along said coanda profile entrains surrounding air so that the volume of air forming said jet stream is increased.

* * * * *